US006689729B2

(12) United States Patent
Hokkirigawa et al.

(10) Patent No.: US 6,689,729 B2
(45) Date of Patent: Feb. 10, 2004

(54) POWDER DETERGENT

(75) Inventors: Kazuo Hokkirigawa, Yonezawa (JP); Motoharu Akiyama, Nagano-ken (JP); Noriyuki Yoshimura, Nagano-ken (JP)

(73) Assignee: Minebea Co., Ltd., Nagano-ken (JP)

( * ) Notice: Subject to any disclaimer, the term of this patent is extended or adjusted under 35 U.S.C. 154(b) by 71 days.

(21) Appl. No.: 10/154,772

(22) Filed: May 24, 2002

(65) Prior Publication Data

US 2003/0008802 A1 Jan. 9, 2003

(30) Foreign Application Priority Data

May 25, 2001 (JP) ..... 2001-157532

(51) Int. Cl.[7] ..... C11D 14/02; C11D 3/00; C11D 9/00; C11D 3/382; C11D 3/384

(52) U.S. Cl. ..... 510/276; 510/395; 510/462

(58) Field of Search ..... 510/276, 315, 510/344, 349, 395, 396, 438, 462

(56) References Cited

U.S. PATENT DOCUMENTS 6,362,143 B2 * 3/2002 Satoh ..... 510/130

OTHER PUBLICATIONS

Article: *Development of Hard and Porous Carbon Material "RB Ceramics" Using Rice Bran as a Starting Material*; (Translation from "Zairyou Kagaku", vol. 17, No. 6, pp. 24 to 27, May 1997); Kazuo Hokkirigawa; 10 pages.

* cited by examiner

*Primary Examiner*—Yogendra N. Gupta
*Assistant Examiner*—John M. Petruncio
(74) *Attorney, Agent, or Firm*—Flynn, Thiel, Boutell & Tanis, P.C.

(57) ABSTRACT

There is provided powder detergent containing a surfactant, a powder modifier, a fragrance and a builder, in which the powder modifier comprises a RB ceramics powder and/or CRB ceramics powder at least as one component thereof. The present powder detergent exhibits high stain removability and powder properties as well as improved long term fragrance stability.

14 Claims, No Drawings

POWDER DETERGENT

FIELD OF THE INVENTION

The present invention relates to powder detergent of high stain removability and powder properties as well as improved long-term fragrance stability.

BACKGROUND OF THE INVENTION

Powder detergent has been mass-produced mainly for the purpose of using in full automatic washing machine, in which especially so-called compact detergent of high bulk density is the most popular because of convenience of saving space of storage, the advantage of packaging and transportation and a smaller amount of detergent to be used per laundry.

Further improvement in cleaning properties such as stain removability, or powder properties and fragrance stability are required, although conventional powder detergent has been improved to some extent.

SUMMARY OF THE INVENTION

Accordingly, it is an object of the present invention to provide powder detergent of high stain removability and powder properties as well as improved long term fragrance stability.

The inventors have found that a powder of RB ceramics or CRB ceramics, which will be described later, is useful for improving powder properties of powder detergent, makes it easy to remove stains due to rough surface of these ceramics with numerous pointed protrusions and controls fast emission of fragrance to improve its long-term aromatic stability. It was difficult to keep stable fragrant emission in conventional powder detergent such as pack detergent over a long period of time after a package thereof is opened. The present invention has been developed based on the above mentioned knowledge.

It is a characteristic feature of the present invention that powder detergent comprises a surfactant, powder modifier, fragrance and builder, in which a powder of RB ceramics or CRB ceramics is contained at least as a component of the powder modifier.

PREFERRED EMBODIMENTS OF THE INVENTION

RB ceramics used in the present powder detergent is a powder of RB ceramics or CRB ceramics formed by grinding these ceramics to particles of 1 to 100 $\mu$m.

Each material of RB ceramics and CRB ceramics used in the present invention is prepared by the following manner.

As is known, Dr. Kazuo Hokkirigawa, the first inventor of the present invention, proposed an idea to obtain a porous carbon material by the use of rice bran which is by-produced 0.9 million ton/year in Japan or 3.3 million ton/year in the world (see, Kinou Zairyou, Vol. 17, No. 5, pp. 24 to 28, May 1997).

The above mentioned literature describes a method for preparing a carbon material or so-called RB ceramics by mixing and kneading a defatted product of rice bran and a thermosetting resin, press-molding the mixture to form a molded material, drying and then baking the dried material in an atmosphere of inert gas.

Defatted rice bran used in the present invention is not limited to a specific species of rice and may either be a product of Japan or foreign countries.

A thermosetting resin used herein may also be any resin which can be thermally set and typically includes phenol-, diarylphthalate-, unsaturated polyester-, epoxy-, polyimide- and triazine resins, although a phenol resin is preferably used.

A thermoplastic resin such as polyimide may also be used together without departing from a scope of the present invention.

A mixing ratio of the defatted rice bran to the thermosetting resin is in the range of 50 to 90:50 to 10 and preferably 70 to 80:30 to 20 in by weight.

According to the above mentioned method, difference in ratio of shrinkage between the press-molded material and the finally molded material which is baked in an atmosphere of inert gas reached almost 25%.

Such a difference made it substantially difficult to form a precisely molded material, but has been finally improved as a result of development of CRB ceramics.

CRB ceramics used in the present invention is an improved material of RB ceramics obtained from defatted rice bran and a thermosetting resin. The defatted product of rice bran and the thermosetting resin are mixed and kneaded, primarily baked in an inert gas at 700 to 1,000° C. and ground to form a carbonated powder of about 60 mesh or less. The powder is then mixed and kneaded with the thermosetting resin to yield a mixture, press-molded at a pressure of 20 to 30 Mpa and further heat-treated the thus molded material in an atmosphere of inert gas at 100 to 1,100° C. to form CRB ceramics as a black resin or porous product.

General properties of RB ceramics and CRB ceramics are as in the following:

- extremely high hardness;
- oil absorptive;
- extremely small heat expansion coefficient;
- porous structure;
- electrical conductivity;
- low specific gravity, light weighted;
- improved abrasion resistance;
- easiness of molding and mold die making;
- capable of being powdered; and
- less negative effect to global environment and more resource conservation due to rice bran to be used as a starting material.

The most typical distinction of RB ceramics and CRB ceramics is that a difference in ratio of shrinkage between molded RB ceramics and a final product thereof is almost 25%, while that of CRB ceramics is so low as 3% or less, which makes the latter material much useful. However, such distinction between them is not important in the present invention, because the final product is formed not as a molded material but as a powder. So, either of RB ceramics or CRB ceramics may basically be used in the present invention.

Hardness is an important factor of RB ceramics and/or CRB ceramics used in the present invention, which is influenced by the primary baking temperature of RB ceramics and both of the primary baking temperature and the secondary heat-treating temperature of CRB ceramics.

In general, the primary baking and the secondary heat treatment at a temperature of 500 to 1,000° C. yield RB ceramics or CRB ceramics of high hardness.

Particle size of a RB ceramics or CRB ceramics powder may vary depending on the purpose to be used but usually in the range of 1 to 100 $\mu$m in average particle diameter.

RB ceramics and CRB ceramics as a material used as a powder modifier of the present powder detergent are prepared from a defatted product of rice bran as a main starting material and a thermosetting resin.

Defatted rice bran used in the present invention is not limited to a specific species of rice and may either be a product of Japan or foreign countries.

A thermosetting resin used herein may also be any resin which can be thermally set and typically includes phenol-, diarylphthalate-, unsaturated polyester-, epoxy-, polyimide- and triazine resins, although a phenol resin is preferably used.

A thermoplastic resin such as polyimide may also be used together without departing from a scope of the present invention.

A mixing ratio of the defatted rice bran to the thermosetting resin is in the range of 50 to 90:50 to 10 and preferably 70 to 80:30 to 20 in by weight.

A method for preparing CRB ceramics will be briefly described below.

The defatted product of rice bran and the thermosetting resin are mixed and kneaded, primarily baked in an inert gas at 700 to 1,000° C. and ground, which is then press-molded at a pressure of 20 to 30 Mpa and further heat-treated the thus molded material in an atmosphere of inert gas at 100 to 1,100° C.

The thermosetting resin used in the primary baking is desirably liquid of relatively low molecular weight.

The primary baking is usually conducted by means of a rotary kiln over a baking time of 40 to 120 minutes. A mixing ratio of a carbon powder obtained by the primary baking and a thermosetting resin is 50 to 90:50 to 10 and preferably 70 to 80:30 to 20 by weight.

A pressure added to the kneaded mixture of the carbon powder and thermosetting resin to press-mold is 20 to 30 Mpa and preferably 21 to 25 Mpa. The mold die temperature is preferably 150° C.

The heat treatment is conducted by means of a well-controlled electric furnace over a heat-treating time of 60 to 360 minutes.

A preferable heat-treating temperature is 500 to 1,100° C., while a rate of rising the temperature is required to be relatively slow up to 500° C. i.e., the heat rising rate is 0.5 to 2° C. and preferably about 1° C. per minute.

It is also required to lower the temperature relatively slowly down to 500° C. after baking, followed by natural heat dissipation under 500° C. i.e., the cool down rate is 0.5 to 4° C. and preferably about 1° C. per minute.

An inert gas used for the primary baking and the heat treatment may be any one of helium, argon, neon or nitrogen, although nitrogen is preferable.

According to the present invention, RB ceramics or CRB ceramics is used as a powder and an average particle diameter thereof is preferably 1 to 100 $\mu$m.

The thus prepared RB ceramics or CRB ceramics is porous, light in weight and sufficiently abrasion resistant and is provided in the form of powder as a novel powder modifier.

It is observed by photomicrography that a powder of RB ceramics or CRB ceramics has numerous pointed protrusions on the surface of each particle, which would probably improve the stain removability by abrading persistent stains and taking them off easily. In addition to such a surface condition, it is presumed that the powder covers over, for example, the surface of a granular mixture of surfactant and builder, thereby caking of the mixture being controlled due to porosity of the powder. Further, porous properties of the powder allows to absorb a fragrant component and increase or maintain its fragrance stability for a long time.

A powder of RB ceramics and/or CRB ceramics is energized by an action of water flow and attacks the surface of laundry in proportion to the square of particle diameter.

Thus, a powder of RB ceramics and/or CRB ceramics having relatively large average particle diameter of 50 to 100 $\mu$m is suitable to heavily oil-stained industrial laundry such as work clothes or gloves, while the powder of relatively small average particle diameter of 1 to 30 $\mu$m is useful for domestic laundry.

Powder detergent of the present invention may further comprise the other powder modifier usually used in conventional powder detergent.

Such a powder modifier includes, for example, amorphous silica, calcium silicate, magnesium silicate, silica-alumina, zeolite, mullite, bentonite, talc, hectorite, calcium carbonate, magnesium carbonate, magnesium oxide, titanium oxide, mica, boron nitride, modified starch, cellulose ether, etc. The modifier may be used alone or as a combination of two or more compounds.

A fragrance used in the present powder detergent is those compounds which are usually used in conventional powder detergent and have a fragrance inducing functional group, such as hydroxy-, aldehyde-, ester-, ketone-, nitro-, amino-, ether- or cyano group or double bond. Terpene hydrocarbon and its derivatives are typically used as such compounds.

An example of terpene hydrocarbon and its derivatives used in the present invention includes limonene, α-pinene, β-pinene, terpinolene, myrcene, cytronellole, linalool, geraniol, 1-menthone, 1-carvone, camphor, citronellyl acetate, geranyl acetate, terpenyl acetate, citral, citranellal, citronellylnitryl, geranylnitryl, eucalyptol, lillal, anisaldehyde, benzaldehyde, α-n-amylcinnamaldehyde, α-n-hexylcinnamaldehyde, lillyal, heliotropin, cinnamaldehyde, benzyl formate, phenyl ethyl formate, anisyl acetate, benzyl acetate, phenylethylacetate, cinnamylacetate, p-tert-butylcyclohexyl acetate, isoamyl acetate, cis-3-hexyl acetate, etc.

Powder detergent of the present invention further comprises a surfactant and a builder.

Anionic-, nonionic- and amphoteric surfactants are preferably used in the present invention as a surfactant.

The anionic surfactant preferably includes alkylbenzenesulfonate, alkylsulfonate, alkyl ether sulfuric acid ester salt and polyoxyalkylene alkylpheny ether sulfuric acid ester salt.

The nonionic surfactant preferably includes polyoxyalkylene alkyl ether, poly-oxyalkylene alkylphenyl ether, fatty acid alkanolamide, fatty acid alkanolamide alkylene oxide adduct and amine oxide such as alkyldimethylamine oxide.

The amphoteric surfactant preferably includes alkyldimethyl acetate betaine and alkylamido betaine.

A builder used in the present invention includes nitrilotriacetic acid (NTA), ethylenediaminetetraacetic acid (EDTA), sodium aluminosilicate, sodium silicate, sodium carbonate, sodium hydrogencarbonate, potassium carbonate, etc.

The present powder detergent may further be blended with additives usually used in conventional powder detergent without departing the object and effects of the present invention, such as filler, fluorescent agent, enzyme, bleaching agent, bleaching activator, recontamination inhibitor, reducing agent, foam controlling agent, coloring agent, etc., if necessary.

Typical examples of these additives are as in the following;

Filler: sodium sulfate, potassium sulfate, sodium chloride and potassium;

Fluorescent agent: bis(triazinylamino)stilbene disulfonate derivative and bis-(sulfostyryl) biphenyl salt;

Enzyme: lipase, protease, cellulase and amilase;

Bleaching agent: percarbonate and perborate;

Bleaching activator: sodium dodecanoyloxybenzenesulfonate and decanoyl-benzenesulfonic acid;

Recontamination inhibitor: polyethylene glycol, sodium carboxymethylcellulose and polyvinyl alcohol;

Reducing agent: sodium sulfite and potassium sulfite; and

Foam controlling agent: silicone oil and silicone compound.

The above mentioned arbitrary components may be blended to the present powder detergent by various blending manners. For example, these components may either be blended during a granulating process or mixed to detergent granules formed by the granulating process.

The present powder detergent may be prepared by a variety of known methods, e.g., spray drying.

In order to prepare the present detergent of high bulk density, a surfactant such as nonionic surfactant, builder, fragrance and arbitrary components may be introduced into kneading and extruding machine, e.g.; kneader and extruder, and mixed to form granules under a shearing condition, which are then crushed to form particles of proper particle size by means of a crushing granulator such as cutter mill in the presence of grinding medium and introduced into a rolling drum to mix with enzyme. In this manner, it is possible to yield powder detergent of 0.5 g/cm$^3$ or more, and preferably 0.6 to 1.1 g/cm$^3$ in bulk density.

There may be used a high-speed mixer or granulating machine of inside-stirring type such as Shugi mixer, Loedige mixer and Henschel mixer alone instead of a combination of kneading extrude, as above mentioned, and crushing granulator for granulation.

The thus prepared powder detergent particles may be subjected to a coating treatment by, for example, mixing the particles with a powder modifier in a rolling drum. The flow properties of detergent can be improved by such a treatment. Preferably, a particle diameter of the powder modifier is so fine that more than 50% of the particles pass through a 200-mesh JIS screen.

There will be described each content of the above mentioned components comprised in the total amount of the present powder detergent. The content of surfactant is preferably in the range of 15 to 80%, more preferably 20 to 70% and the most preferably 20 to 60% by mass. When the content is less than 15% by mass, the surfactant concentration in the resulted powder detergent is lowered, while sufficient detergency is not obtained without using a large amount of detergent because of low bulk density, which makes it difficult to yield a compact product or to conduct detergent production successfully. The thus yielded detergent is inferior in powder properties, or has a difficulty in controlling leach-out of the surfactant.

A powder of RB ceramics or CRB ceramics used in the present invention is preferably in the range of 0.1 to 10% by mass and practically 1 to 5% by mass. The amount less than 1% by mass does not result in a sufficient effect to be expected, while the amount more than 10% by mass neither exerts any quantitative effect.

A powder modifier other than the ceramics used in the present invention is preferably in the range of 0.5 to 35% by mass, and practically 1 to 30% by mass.

A builder used in the present invention is preferably in the range of 15 to 80% by mass, more preferably 20 to 70% by mass and practically 30 to 60% by mass.

The embodiments of the present invention will be summarized as in the following.

1. Powder detergent containing a surfactant, a powder modifier, a fragrance and a builder, in which the powder modifier comprises a RB ceramics powder and/or CRB ceramics powder at least as one component thereof.

2. Powder detergent described in the above item 1 which further comprises one or more than two compound selected from a group consisting of amorphous silica, calcium silicate, silica-alumina, zeolite, bentonite, talc, calcium carbonate, magnesium oxide, titanium oxide, mica, boron nitride, modified starch and cellulose ether as a powder modifier.

3. Powder detergent described in the above item 1 or 2 in which a surfactant is an anionic surfactant, nonionic surfactant or amphoteric surfactant.

4. Powder detergent described in the above item 1 or 2 in which a surfactant comprises an anionic surfactant and a nonionic surfactant.

5. Powder detergent described in the above item 1 or 2 in which a surfactant comprises a nonionic surfactant and an amphoteric surfactant.

6. Powder detergent described in the above item 3 or 4 in which an anionic surfactant is alkylbenzenesulfonate, alkylsulfonate, alkyl ether sulfuric acid ester salt or polyoxyalkylene alkylpheny ether sulfuric acid ester salt.

7. Powder detergent described in the above item 3 4 or 5 in which a nonionic surfactant is polyoxyalkylene alkyl ether, polyoxyalkylene alkylphenyl ether, fatty acid alkanolamide, fatty acid alkanolamide alkylene oxide adduct and amine oxide.

8. Powder detergent described in any one of the above items 1 to 7 in which a content of RB ceramics powder and/or CRB ceramics powder is 0.1 to 10% by mass of total amount of the powder detergent.

9. Powder detergent described in any one of the above items 1 to 8 in which a content of powder modifier is 0.5 to 15% by mass of total amount of the powder detergent.

10. Powder detergent described in any one of the above items 1 to 9 in which a content of surfactant is 15 to 80% by mass of total amount of the powder detergent.

11. Powder detergent described in any one of the above items 1 to 10 in which content of a builder is 10 to 80% by mass of total amount of the powder detergent.

12. Powder detergent described in any one of the above items 1 to 11 in which an average particle diameter of RB ceramics and/or CRB ceramics is 1 to 100 $\mu$m.

13. Powder detergent described in the above item 12 useful for general domestic laundry in which an average particle diameter of RB ceramics or CRB ceramics is 1 to 30 $\mu$m.

14. Powder detergent described in the above item 12 useful for industrial laundry of working clothes, gloves, etc. in which an average particle diameter of RB ceramics or CRB ceramics is 50 to 100 $\mu$m.

As has been described above, powder detergent of the present invention has high stain removability and powder properties as well as improved long-term fragrance stability.

The present invention will be further detailed by the following examples, however it should be understood that the present invention is not restricted by these examples. All parts and percentages used in the examples are based on by mass and by mass %, respectively.

Fragrant compositions used herein are as in the following.

Fragrance A (apple-floral smell): 2% of trans-2-hexanol, 40% of phenylethy alcohol, 5% of phenylethyl n-butylate, 3% of 2-cyclohexylpropanal, 5% of α-hexyl-cinnamic aldehyde, 5% of anisaldehyde, 15% of cyclamen aldehyde and 25% of benzyl acetate.

Fragrance B (rose-fruity smell): 55% of phenylethyl alcohol, 20% of phenylethyl pivalate, 2% of vanillin, 5% of lilial, 3% of anisaldehyde, 5% of benzyl acetate, and 10% of phenylethyl acetate.

Fragrance C (lemon-muguet smell): 20% of phenylethyl alcohol, 20% of limonene, 5% of citral, 10% of lilial, 20% of α-hexylcinnamic aldehyde, 15% of lilal and 10% of benzyl acetate.

EXAMPLE 1

Preparation of RB Ceramics Powder

A defatted product of rice bran in an amount of 75 kg and a liquid phenol resin (resol) in an amount of 25 kg were mixed and kneaded by heating at 50 to 60° C. to form a plastic and homogeneous mixture.

The mixture was molded into a spherical body of 3 cm in diameter and baked by means of a rotary kiln in a nitrogen atmosphere at 950° C. for 60 minutes. The thus baked and carbonized product was granulized in a grinder and further pulverized by means of a ball mil to form a RB ceramic powder of 5 μm in average particle diameter as primary particles (hereinafter referred to as RB-A). Then, there was prepared a powder detergent composition comprising 5 g of RB-A, 25 g of calcium silicate, 50 g of sodium dodecylbenzenesulfonate, 10 g of NTA, 10 g of sodium sulfate and 0.5 g of fragrance-A, while adding a slight amount of moisture.

EXAMPLE 2

A RB ceramics powder of 2 μm in average particle diameter as primary particles was obtained in a similar manner as described in Example 1 (hereinafter referred to as RB-B). Then, there was prepared a powder detergent composition comprising 5 g of RB-A, 25 g of calcium carbonate, 50 g of sodium dodecylbenzenesulfonate, 10 g of EDTA, 10 g of sodium sulfate and 0.5 g of fragrance-B, while adding a slight amount of moisture.

EXAMPLE 3

Preparation of CRB Ceramics Powder

A defatted product of rice bran in an amount of 75 kg and a liquid phenol resin (resol) in an amount of 25 kg were mixed and kneaded by heating at 50 to 60° C. to form a plastic and homogeneous mixture.

The mixture was primarily baked by means of a rotary kiln in a nitrogen atmosphere at 950° C. for 60 minutes. The thus baked and carbonized product was screened through a 100-mesh screen to yield a carbonized powder of 50 to 250 μm in particle diameter.

The carbonized powder in an amount of 75 kg and a solid phenol resin (resol) in an amount of 25 kg were mixed and kneaded by heating at 100 to 150° C. to form a plastic and homogeneous mixture.

The mixture was molded into a spherical body of 3 cm in diameter and baked by means of a rotary kiln in a nitrogen atmosphere at a secondary baking temperature of 600° C. The thus baked and carbonized product was granulized in a grinder and further pulverized by means of a ball mil to form a CRB ceramic powder of 20 μm in average particle diameter as primary particles (hereinafter referred to as CRB-A). Then, there was prepared a powder detergent composition comprising 3 g of CRB-A, 50 g of polyoxyethylene (p=10) dodecyl ether, 25 g of calcium silicate, 12 g of sodium silicate, 10 g of sodium sulfate and 0.5 g of fragrance-C, while adding a slight amount of moisture.

EXAMPLE 4

A CRB ceramics powder of 15 μm in average particle diameter as primary particles was obtained in a similar manner as described in Example 3 except that the secondary baking temperature was 700° C. (hereinafter referred to as CRB-B). Then, there was prepared a powder detergent composition comprising 5 g of CRB-B, 35 g of sodium dodecylbenzenesulfonate, 12 g of sodium carbonate, 15 g of NTA, 10 g of sodium sulfate and 0.5 g of fragrance-A, while adding a slight amount of moisture.

EXAMPLE 5

A CRB ceramics powder of 10 μm in average particle diameter as primary particles was obtained in a similar manner as described in Example 3 except that the secondary baking temperature was 800° C. (hereinafter referred to as CRB-C). Then, there was prepared a powder detergent composition comprising 3 g of CRB-C, 45 g of polyoxyethylene (p=3) dodecyl ether sodium sulfate, 20 g of zeolite, 12 g of NTA, 20 g of sodium sulfate and 0.5 g of fragrance-B, while adding a slight amount of moisture.

EXAMPLE 6

A CRB ceramics powder of 5 μm in average particle diameter as primary particles was obtained in a similar manner as described in Example 3 except that the secondary baking temperature was 900° C. (hereinafter referred to as CRB-D). Then, there was prepared a powder detergent composition comprising 2 g of CRB-d, 60 g of polyoxyethylene (p=10) dodecyl ether, 18 g of amorphous silica, 10 g of NTA, 10 g of sodium sulfate and 0.5 g of fragrance-C, while adding a slight amount of moisture.

Examples 7 to 12 and Comparative Examples 1 to 6.

There were prepared various powder detergent compositions as shown Table 1.

TABLE 1

| | Examples | | | | | | | | | | | | Comparative Examples | | | | | |
|---|---|---|---|---|---|---|---|---|---|---|---|---|---|---|---|---|---|---|
| | Ex. No. 1 | 2 | 3 | 4 | 5 | 6 | 7 | 8 | 9 | 10 | 11 | 12 | 1 | 2 | 3 | 4 | 5 | 6 |
| RB-A | 5 | | | | | | 12 | | | | | | | | | | | |
| RB-B | | 5 | | | | | | 3 | | | | | | | | | | |
| CRB-A | | | 3 | | | | | | 13 | | | | | | | | | |
| CRB-B | | | | 5 | | | | | | 10 | | | | | | | | |
| CRB-C | | | | | 3 | | | | | | 6 | | | | | | | |

TABLE 1-continued

| | Examples | | | | | | | | | | | | Comparative Examples | | | | | |
|---|---|---|---|---|---|---|---|---|---|---|---|---|---|---|---|---|---|---|
| | Ex. No. 1 | 2 | 3 | 4 | 5 | 6 | 7 | 8 | 9 | 10 | 11 | 12 | 1 | 2 | 3 | 4 | 5 | 6 |
| CRB-D | | | | | | 2 | | | | | | 1 | | | | | | |
| Ca silicate | 25 | | 25 | 15 | | | 18 | | | | | | 30 | | | | 15 | |
| Ca carbonate | | 25 | | 10 | | | | | | | | | | 20 | | | 15 | |
| zeolite | | | | | 20 | | | 20 | | | | 17 | | | 20 | | | |
| amorphous silica | | | | | | 18 | | | 10 | | 15 | | | | | 18 | | 20 |
| DBSNa | 50 | 50 | | 35 | | | 50 | 30 | | | | | 50 | 50 | | | | |
| PDSNa | | | | | 45 | | | | | | 40 | | | | | | | |
| DSNa | | | | | | | | | 50 | | | | | | 50 | | | |
| PODE | | | 50 | | | 60 | | 20 | | | | | | | | 60 | | |
| LEN | | | | | | | | | | 50 | | | | | | | 50 | |
| DDAO | | | | | | | | | | | | 50 | | | | | | 50 |
| NTA | 10 | | | 15 | 12 | | 10 | | | | | | 10 | | | | | 10 |
| EDTA | | 10 | | | | | | 7 | | 15 | 10 | | | 10 | 10 | | 10 | |
| Na carbonate | | | | 12 | | | | | 8 | | 9 | 10 | | | | | | |
| Na silicate | | | 12 | | | 10 | | 10 | 9 | 15 | 10 | 10 | | | 10 | 12 | | 10 |
| Na sulfate | 10 | 10 | 10 | 8 | 20 | 10 | 10 | 10 | 10 | 10 | 10 | 12 | 10 | 20 | 10 | 10 | 10 | 10 |
| fragrance-A | 0.5 | | | 0.5 | | | 0.5 | | | 0.5 | | | 0.5 | | | 0.5 | | |
| fragrance-B | | | | | 0.5 | | | 0.5 | | | 0.5 | | | 0.5 | | | 0.5 | |
| fragrance-C | | 0.5 | 0.5 | | | 0.5 | | | 0.5 | | | 0.5 | | | 0.5 | | | 0.5 |
| removability | good | good | good | good | good | good | good | good | good | good | good | good | fair | fair | fair | fair | fair | fair |
| fragrance stability | good | good | good | good | good | good | good | good | good | good | good | good | failure | failure | failure | failure | failure | failure |

Abbreviations used in Table 1 are as in the following:
DBSNa: sodium dodecylbenzensulfonate;
PDSNa: polyoxyethylene (p = 3) dodecyl ether sodium sulfate;
DSNa: sodium dodecylsulfonate;
PODE: polyoxyethylene (p = 10) dodecyl ether
LEN: lauric acid diethanolamide;
DDAO: dodecyldimethylamine oxide.

Abbreviations used in Table 1 are as in the following:

DBSNa: sodium dodecylbenzensulfonate;

PDSNa: polyoxyethylene (p=3) dodecyl ether sodium sulfate;

DSNa: sodium dodecylsulfonate;

PODE: polyoxyethylene (p=10) dodecyl ether

LEN: lauric acid diethanolamide;

DDAO: dodecyldimethylamine oxide.

Samples of each powder detergent prepared in Examples 1 to 12 and Comparative Examples 1 to 6 were used to wash stained clothes in a washing tub with washing water containing respective detergent in predetermined concentration. After drying the washed clothes, the stain removability was visually evaluated by ten panel members based on a three-grading method; good, fair and failure. The result is shown in Table 1.

Further, each of these samples in an amount of 50 $cm^3$ was placed in a wide mouth opened vessel of 100 $cm^3$ in volume and subjected to an organoleptic evaluation of fragrance stability by ten panel members for the first time soon after the samples were placed and the second time after allowing them to stand for 20 days in the air at room temperature in a similar manner as described above. The result is shown in Table 1.

What is claimed is:

1. Powder detergent containing a surfactant, a powder modifier, a fragrance and a builder, in which the powder modifier comprises a RB ceramics powder and/or CRB ceramics powder at least as one component thereof.

2. Powder detergent claimed in claim 1 which further comprises at least one compound selected from a group consisting of amorphous silica, calcium silicate, silica-alumina, zeolite, bentonite, talc, calcium carbonate, magnesium oxide, titanium oxide, mica, boron nitride, modified starch and cellulose ether as a powder modifier.

3. Powder detergent claimed in claim 1 in which a surfactant is an anionic surfactant, nonionic surfactant or amphoteric surfactant.

4. Powder detergent claimed in claim 1 in which a surfactant comprises an anionic surfactant and a nonionic surfactant.

5. Powder detergent claimed in claim 1 in which a surfactant comprises a nonionic surfactant and an amphoteric surfactant.

6. Powder detergent claimed in claim 3 in which an anionic surfactant is alkylbenzenesulfonate, alkylsulfonate, alkyl ether sulfuric acid ester salt or polyoxyalkylene alkylphenyl ether sulfuric acid ester salt.

7. Powder detergent claimed in claim 3 in which a nonionic surfactant is polyoxyalkylene alkyl ether, polyoxyalkylene alkylphenyl ether, fatty acid alkanolamide, fatty acid alkanolamide alkylene oxide adduct and amine oxide.

8. Powder detergent claimed in claim 1 in which a content of RB ceramics powder and/or CRB ceramics powder is 0.1 to 10% by mass of total amount of the powder detergent.

9. Powder detergent claimed in claim 1 in which a content of powder modifier is 0.5 to 35% by mass of total amount of the powder detergent.

10. Powder detergent claimed in claim 1 in which a content of surfactant is 15 to 80% by mass of total amount of the powder detergent.

11. Powder detergent claimed in claim 1 in which the content of a builder is 10 to 80% by mass of total amount of the powder detergent.

12. Powder detergent claimed in claim 1 in which an average particle diameter of RB ceramics and/or CRB ceramics is 1 to 100 $\mu$m.

13. Powder detergent claimed in claim 12 useful for general domestic laundry in which an average particle diameter of RB ceramics or CRB ceramics is 1 to 30 $\mu$m.

14. Powder detergent claimed in claim 12 useful for industrial laundry of working clothes or gloves in which an average particle diameter of RB ceramics or CRB ceramics is 50 to 100 $\mu$m.

* * * * *